US007845325B2

(12) United States Patent
Yamamoto et al.

(10) Patent No.: US 7,845,325 B2
(45) Date of Patent: Dec. 7, 2010

(54) VALVE ACTUATING MECHANISM FOR AN INTERNAL COMBUSTION ENGINE, AND ENGINE INCORPORATING SAME

(75) Inventors: Toshio Yamamoto, Saitama (JP); Masahiro Kuroki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 440 days.

(21) Appl. No.: 12/079,674

(22) Filed: Mar. 27, 2008

(65) Prior Publication Data

US 2008/0236531 A1 Oct. 2, 2008

(51) Int. Cl.
*F01L 1/18* (2006.01)

(52) U.S. Cl. ..... 123/90.39; 123/90.16; 74/569

(58) Field of Classification Search ..... 123/90.16, 123/90.39; 74/569

See application file for complete search history.

(56) References Cited

U.S. PATENT DOCUMENTS

| | | | | |
|---|---|---|---|---|
| 3,878,822 | A | 4/1975 | Beal | |
| 4,253,434 | A | 3/1981 | Takizawa et al. | |
| 4,354,460 | A | 10/1982 | Mae et al. | |
| 4,499,870 | A * | 2/1985 | Aoyama | 123/198 F |
| 4,534,323 | A | 8/1985 | Kato et al. | |
| 5,203,289 | A | 4/1993 | Hara et al. | |

FOREIGN PATENT DOCUMENTS

| | | | |
|---|---|---|---|
| DE | 33 16446 | A1 | 11/1983 |
| DE | 33 46 556 | A1 | 7/1984 |
| DE | 33 15396 | A1 | 10/1984 |
| DE | 195 44 242 | A1 | 6/1996 |
| JP | 60-85205 | | 5/1985 |
| JP | 2001-020710 | | 1/2001 |

* cited by examiner

*Primary Examiner*—Zelalem Eshete
(74) *Attorney, Agent, or Firm*—Carrier Blackman & Associates, P.C.; Joseph P. Carrier; William D. Blackman

(57) ABSTRACT

A valve actuating mechanism for an engine having a rocker arm movement restraining device which controls opening and closing an engine valve. The rocker arm movement restraining device includes a timing arm which engages left and right rocker arms for constraining the axial movement thereof, and a timing cam disposed on an intake-side camshaft. The rocker arm movement restraining device releases the engagement of the timing arm with the left and right rocker arms by activating the timing arm when the intake-side camshaft is rotated, and when the timing arm releases the engagement with the left and right rocker arms, the left and right rocker arms move to a predetermined operating position.

20 Claims, 9 Drawing Sheets

VALVE ACTUATING MECHANISM FOR AN INTERNAL COMBUSTION ENGINE, AND ENGINE INCORPORATING SAME

CROSS-REFERENCE TO RELATED APPLICATIONS

The present application claims priority under 35 USC §119 based on Japanese patent application No. 2007-095092, filed on Mar. 30, 2007. The entire subject matter of this priority document is incorporated by reference herein.

BACKGROUND OF THE INVENTION

1. Field of the Invention

The present invention relates to a variable valve actuating mechanism for an internal combustion engine. More particularly, the present invention relates to a valve actuating mechanism for a four-stroke engine suitable for vehicles such as motorcycles in which a camshaft includes a pair of cams for each engine valve so that one of the cams is selectively employed for opening and closing operation of the engine valves.

2. Description of the Background Art

There are a number of known valve actuating mechanisms for internal combustion engines. Generally, a valve actuating mechanism includes a rocker arm supported by a rocker arm shaft extending parallel to the camshaft so as to be capable of pivoting about the axis thereof and to be movable in the axial direction.

The rocker arm selectively comes in contact with a selected one of the cams, and pivots in accordance with the rotation of the camshaft to open and close the engine valve. The one of the cams is selectively used for opening and closing the engine valve by moving the rocker arm as needed in the axial direction.

An example of such known valve actuating mechanism for an engine is disclosed in the Japanese Patent Document No. JP-A-2001-20710.

According to the Japanese Patent Document No. JP-A-2001-20710, the movement of the rocker arm in the axial direction is achieved by using the engine oil pressure. However, since the camshaft is in a state of pushing the engine valve downward via the rocker arm (valve-open state) depending on whether the engine valve is opened or closed, there is a problem that a strong force must be applied to the rocker arm.

When an electrical sensor or control is used for moving the rocker arm according to whether the engine valve is opened or closed, there arises a problem that the configuration of the mechanism itself becomes complicated.

The present invention has been made to overcome such drawbacks. Accordingly, it is an object of the present invention to provide a valve actuating mechanism for an engine for operating cams for opening and closing an engine valve by controllably movement of a rocker arm in the direction of an axis of pivotal movement, and in which movement of the rocker arm is enabled based on whether the engine valve is in a opened or a closed state.

SUMMARY OF THE INVENTION

In order to achieve the above object, the present invention according to a first aspect thereof provides a valve actuating mechanism (also referred as a variable valve actuating mechanism) for an engine having a camshaft including a pair of first and second cams for each engine valve, a rocker arm shaft extending parallel to the camshaft, and rocker arms supported on the rocker arm shaft. The rocker arms are pivotally supported on the rocker arm shaft, and are movable in the axial direction thereof.

During an engine operation, the rocker arms come in contact with one of the cams and hence pivot to open and close the engine valves according to the rotation of the camshaft. The rocker arms move in an axial direction to one of a first operating position and a second operating position. In the first operating position, the rocker arms come in contact with the first cams, and in the second operating position, the rocker arms come in contact with the second cams, such that one of the cams are selectively used for opening and closing operation of the engine valve.

The valve actuating mechanism includes a first rocker arm moving device (also referred as a first rocker arm moving mechanism) which moves the rocker arms from the first operating position toward the second operating position; a second rocker arm moving device (also referred as a second rocker arm moving mechanism) which moves the rocker arms from the second operating position toward the first operating position; and a rocker arm movement restraining device (also referred as rocker arm movement restraining mechanism) which restrains the movement of the rocker arms in the axial direction.

The valve actuating mechanism of the present invention according to the first thereof is characterized in that the rocker arm movement restraining device includes an arm member (also referred as a timing arm) which engages the rocker arms for constraining the axial movement thereof, and a third cam (also referred as a timing cam) disposed on the camshaft which activates the arm member and releases the engagement thereof with the rocker arms when the camshaft is rotated. The arm member releases the engagement with the rocker arms when the engine valve is closed so that the rocker arms move to one of the first and second operating positions by one of the first and the second rocker arm moving devices.

The present invention according to a second aspect thereof is characterized in that the arm member engages a flange provided on a base portion of the rocker arm, which allows passage of the rocker arm shaft therethrough.

The present invention according to a third aspect thereof is characterized in that a force to move the rocker arms of the rocker arm moving devices in the axial direction is applied to the base portions of the rocker arms so as to allow passage of the rocker arm shaft therethrough.

The present invention according to a forth aspect thereof is characterized in that the rocker arm moving devices respectively include first and second springs which are engaged at one ends thereof with the base portions of the rocker arms, which allow passage of the rocker arm shaft therethrough, and provide a force in the axial direction thereto.

The rocker arm moving devices according to the fourth aspect also include a first and second spring receiving collars supported on the outer periphery of the rocker arm shaft. The first and second spring receiving collars do not move relatively in the axial direction and engage the other ends of respective one of the springs.

The rocker arm movement restraining device according to the fourth aspect further includes a plurality of second arm members for restraining the axial movement of the rocker arms until the predetermined force is accumulated in one of the first and second springs. The rocker arm shaft is supported by an engine structure (e.g., cylinder head) so as to be movable in the axial direction thereof.

The rocker arm shaft moves in the axial direction with respect to the engine structure together with the spring receiving collars in a state in which the second arm members restrain the axial movement of the rocker arms with respect to the engine structure so that the predetermined force is accumulated in one of the first and second springs, and one of the spring receiving collars selectively comes in contact with the second arm members at a moment when the predetermined force is accumulated to release the rocker arm restrained by the second arm members.

ADVANTAGE OF THE INVENTION

According to the first aspect of the present invention, constraint of the movement and release of the rocker arms are mechanically switched according to the state of the rotation of the camshaft, that is, depending on whether the engine valve is opened or closed, so that the movement of the rocker arms depending on whether the engine valve is opened or closed is enabled.

In particular, the movement of the rocker arms in a state in which the engine valve is closed is enabled. Therefore, a force to be applied for moving the rocker arms in the axial direction may be reduced. In addition, an electrical sensor or control, etc. for detecting whether the engine valve is opened or closed is not necessary, so that the valve actuating mechanism is simplified.

Furthermore, in the engine having a plurality of cylinders, the timing of movement of the rocker arms may be set for each cylinder by providing the arm member for each cylinder, so that a valve drive cam may be configured for timings optimal for each cylinder.

According to the second aspect of the present invention, the restraint of the movement of the rocker arms in the axial direction may be carried out in a simple and a reliable manner.

According to the third aspect of the present invention, the movement of the rocker arms in the axial direction is smoothened. With a configuration, as discussed above, in which the arm member engages the base portions (flange) of the rocker arms which receives a force from the rocker arm moving devices, the arm member receives the force from the rocker arm moving devices with high efficiency.

According to the fourth aspect of the present invention, one of the first and second springs is compressed to accumulate the predetermined force by moving the rocker arm shaft in the axial direction together with the spring receiving collars and the restraint of movement of the rocker arms by the second arm members is released in association with the movement of the spring receiving collars, so that the rocker arms are prevented from moving before the rocker arm moving devices accumulate the predetermined force, whereby quick and reliable movement of the rocker arms is achieved.

DETAILED DESCRIPTION OF ILLUSTRATIVE EMBODIMENTS

Figure 1:
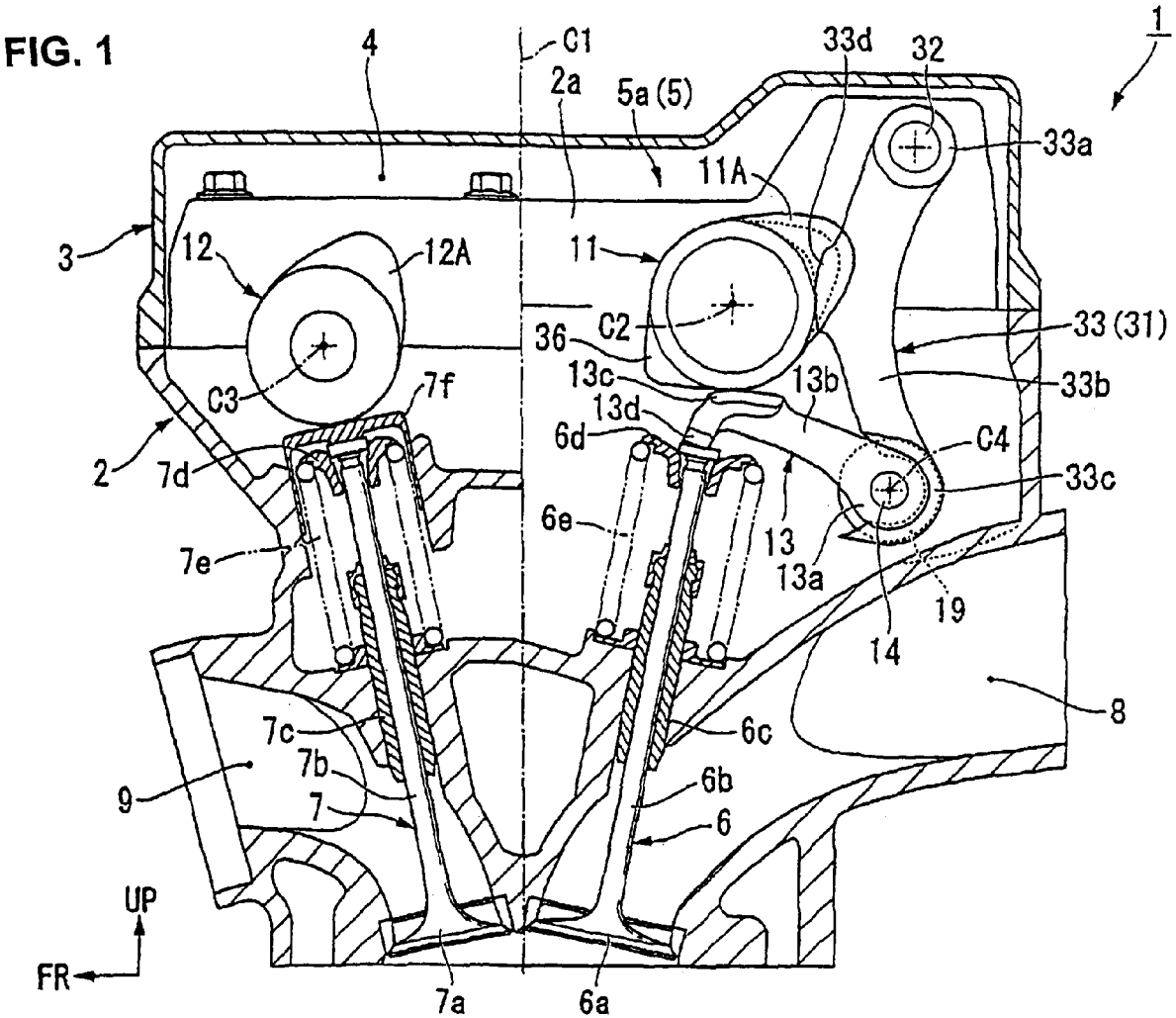
FIG. 1 is a left side view of a cylinder head of an engine according to an illustrative embodiment of the present invention.

It should be understood that only structures considered necessary for illustrating selected embodiments of the present invention are described herein. Other conventional structures, and those of ancillary and auxiliary components of the system, will be known and understood by those skilled in the art.

Referring now to the drawings, an illustrative embodiment of the present invention is described. In the drawings, for convenience of explanation, an arrow FR represents front, an arrow LH represents left, and an arrow UP represents upward.

FIG. 1 is a left side view of a cylinder head 2 of a four-stroke dual overhead camshaft (DOHC) parallel four-cylinder engine 1, which may be used as a prime mover of a vehicle such as a motorcycle. A head cover 3 is attached on the cylinder head 2, and a valve actuating mechanism 5 (also referred a valve device 5, a valve operating device 5 or a variable valve actuating mechanism 5) for driving intake and exhaust valves 6, 7, is stored in a valve chamber 4 defined by an opening formed between the cylinder head 2 and the head cover 3. In FIG. 1, a reference numeral C1 designates a center axis line (cylinder axis line) of a cylinder bore of a cylinder body.

The cylinder head 2 includes intake and exhaust ports 8, 9 for each cylinder. The openings of the intake and exhaust ports 8, 9 on the side of a combustion chamber are opened and closed by the intake and exhaust valves 6, 7, respectively. The valves 6, 7 respectively include umbrella-shaped valve elements 6*a*, 7*a* aligned with the openings on the combustion chamber side, and rod-shaped stems 6*b*, 7*b* extending therefrom toward the valve chamber 4. The stems 6*b*, 7*b* are held in the cylinder head 2 via cylindrical valve guides 6*c*, 7*c*. The stems 6*b*, 7*b* reciprocally move in the cylindrical valve guides 6*c*, 7*c*.

The stems 6*b*, 7*b* of the respective valves 6, 7 include retainers 6*d*, 7*d* attached to the distal end portions thereof, and the respective valves 6, 7 are urged upward by a spring force of valve springs 6*e*, 7*e* provided in a compressed state between the retainers 6*d*, 7*d* and the cylinder head 2 so that the valve elements 6*a*, 7*a* close the openings on the side of the combustion chamber.

During engine operation, when the valves 6, 7 are stroked downward against the urging force of the valve springs 6*e*, 7*e*, the valve elements 6*a*, 7*a* of the valves 6, 7 come apart from and open the openings on the side of the combustion chamber.

The stems 6*b*, 7*b* of the valves 6, 7 are disposed such that they inclined with respect to the cylinder axis line C1 to form a V-shape in side view. The engine 1 includes an intake-side camshaft 11 and an exhaust-side camshaft 12, extending in the transverse direction, disposed respectively above the respective stems 6*b*, 7*b*.

The camshafts 11, 12 are rotatably supported by the cylinder head 2 (including a shaft holder 2*a*). The camshafts 11, 12 rotate in association with a crankshaft (not shown), for example, via a chain-type power transmission mechanism (not shown) during operation the engine 1. In the drawings, reference numerals C2 and C3 designate center axis lines (cam axis lines) of the camshafts 11, 12, respectively.

The engine 1 has a four-valve system, i.e., the engine 1 includes a pair of the left and right intake and exhaust valves 6, 7 for each cylinder.

During engine operation, the intake valve 6 is opened and closed when being pressed by a cam 11A of the intake-side camshaft 11 via a rocker arm 13 provided for each cylinder. However, the each exhaust valve 7 is opened and closed by being directly pressed by a cam 12A of the exhaust-side camshaft 12 via a valve lifter 7*f* attached to the distal end portion of the stem 7*b*, as shown in FIG. 1.

The rocker arm 13 is pivotably supported on a rocker arm shaft 14 disposed in parallel to the camshafts 11, 12. In the drawings, reference numeral C4 designates a center axis line (rocker axis line) of the rocker arm shaft 14.

An arm portion 13*b* of the rocker arm 13 extends from a cylindrical base portion 13*a* which allows passage of the rocker arm shaft 14 toward the distal end portion of the stem 6*b* of the intake valve 6. The arm portion 13*b* is situated on the top of the distal end portion of the stem 6*b* with a cam sliding-contact portion 13*c* with which the cam 11A of the intake-side camshaft 11 comes in sliding contact. The rocker arm 13 includes a valve pressing portion 13*d*, which presses the distal end portion of the stem 6*b* downward during the operation of the engine 1.

When the intake-side camshaft 11 is rotated during the operation of the engine 1, the cam 11A comes in sliding contact with the cam sliding-contact portion 13*c*, to pivot the rocker arm 13 as needed, and the valve pressing portion 13*d* of the rocker arm 13 presses the distal end portion of the stem 6*b* of the intake valve 6 to cause the intake valve 6 to reciprocate along the stem 6*b* (as needed) so that the opening on the side of the combustion chamber is opened or closed. According another embodiment, a configuration in which the rocker arm 13 includes a cam roller which comes into rolling contact with the cam 11A of the intake-side camshaft 11 is also applicable to the present invention.

A variable valve actuating mechanism 5*a* which changes the opening-closing timing or the amount of lift of the respective intake valves 6 is configured on the air-intake side of the valve actuating mechanism 5 of the engine 1. For example, the variable valve actuating mechanism 5*a* opens or closes the respective intake valves 6 using cams for low-speed rotation disposed on the intake-side camshaft 11 in a low-speed rotation range in which the number of revolutions of the engine is less than 6000 rpm (Revolutions Per Minute), and opens or closes the respective intake valves 6 using cams for high-speed rotation disposed on the intake-side camshaft 11 in a high-speed rotation range in which the number of revolutions of the engine is more than 6000 rpm.

Hereinafter, one cylinder of the variable valve actuating mechanism 5*a* is described, and description for other cylinders is omitted as other cylinders have the same configuration.

Figure 2:
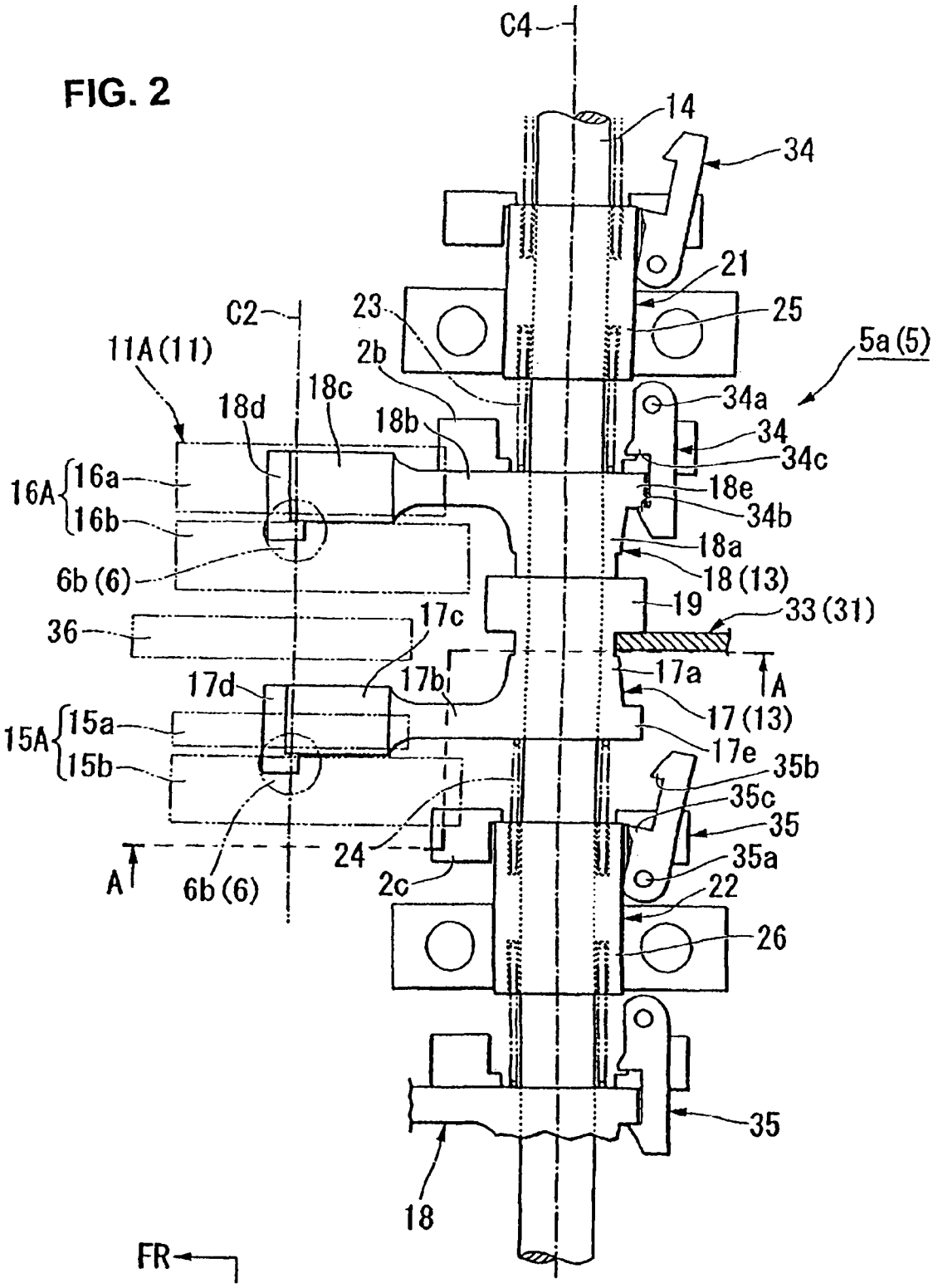
FIG. 2 is a top view of a principal portion of a variable valve actuating mechanism of the engine of FIG. 1 at a time of low-speed operation.

As shown in FIG. 2, the cam 11A of the intake-side camshaft 11 includes left and right first cams 15*a*, 16*a* for the low-speed rotation range, and left and right second cams 15*b*, 16*b* for the high-speed rotation range, corresponding to the left and right intake valves 6.

In other words, the intake-side camshaft 11 includes four cams in total for one cylinder; the left and right first cams 15*a*, 16*a* and the left and right second cams 15*b*, 16*b* which correspond respectively to the left and right intake valves 6.

Hereinafter, sets of the first cams and the associated second cams, which correspond respectively to the left and right intake valves 6, are designated as left and right cam pairs 15A, 16A (the left cam pair 15A includes first cam 15*a* and second cam 15*b*, while the right cam pair 16A includes first cam 16*a* and second cam 16*b*). The left and right cam pairs 15A, 16A are arranged at positions substantially in lateral symmetry with respect to the cylinder axis line C1, and are apart from each other by a predetermined amount in the direction of the cam axis.

The left and right cam pairs 15A, 16A are arranged in such a manner that the first cams 15*a*, 16*a* are arranged on the right side and the second cams 15*b*, 16*b* are arranged on the left side so as to be adjacent to each other in the direction of the cam axis. A timing cam 36 (also referred as a third cam 36) is disposed between the left and right cam pairs 15A, 16A. The timing cam 36 provided for pivoting a timing arm 33 (also referred as an arm member 33) of a rocker arm movement restraining mechanism 31, which is described later.

The rocker arm 13 is pivotally supported on the rocker arm shaft 14, the rocker arm is pivotable (rotatable) about the axis thereof of the rocker arm shaft 14 (about the center of the rocker axis line C4) and movable in the axial direction (the direction toward the rocker axis line C4). The rocker arm 13 is divided into left and right rocker arms 17, 18 which are movable relatively to each other (relatively pivotable about the axis and relatively movable in the axial direction).

The left and right rocker arms 17, 18 are provided corresponding to the left and right intake valves 6 respectively, and the left and right rocker arms 17, 18 open and close the left and right intake valves 6 being pivoted independently by the left and right first cams 15*a*, 16*a* or the second cams 15*b*, 16*b*.

Figure 3:
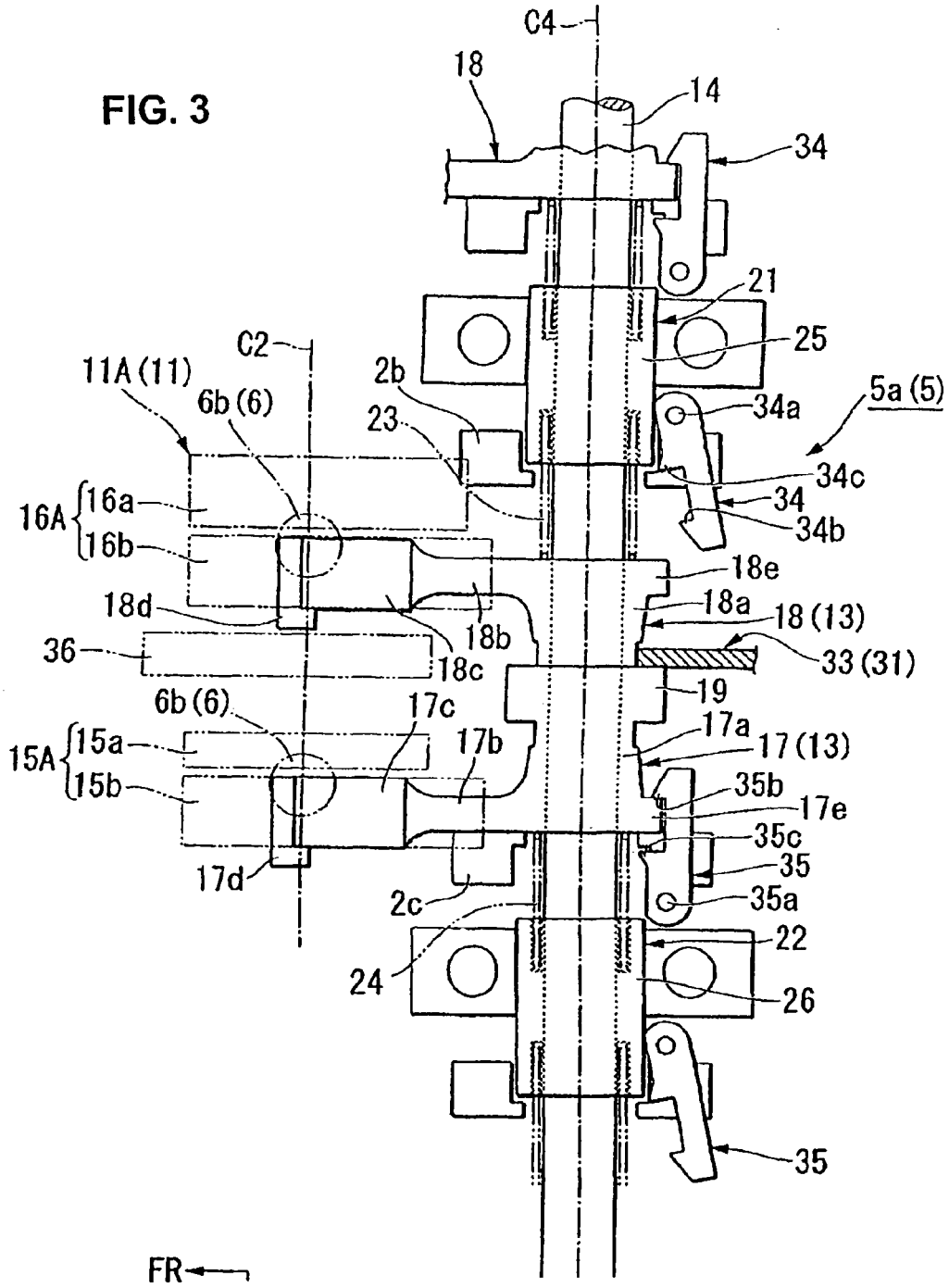
FIG. 3 is a top view of the principal portion of the variable valve actuating mechanism at a time of high-speed operation.
Figure 4:
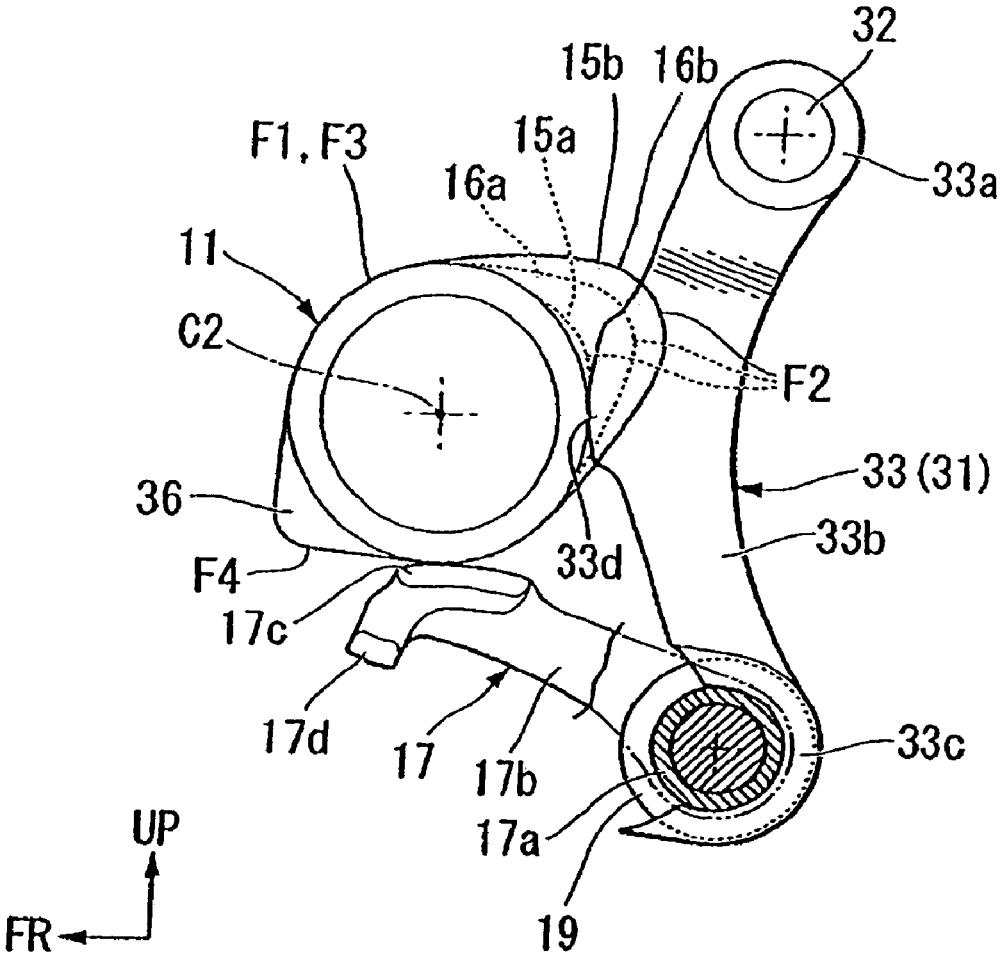
FIG. 4 is a cross-sectional view of the mechanism of FIG. 2, taken along the line A-A therein.

As shown in FIGS. 2-4, the left and right rocker arms include base portions 17*a*, 18*a*, arm portions 17*b*, 18*b*, cam sliding-contact portions 17*c*, 18*c*, and valve pressing portions 17*d*, 18*d*, respectively. The left and right arm portions 17*b*, 18*b*, the cam sliding-contact portions 17*c*, 18*c* and the valve pressing portions 17*d*, 18*d* are offset outward toward the left and right of the cylinder with respect to the centers of the left and right base portions 17*a*, 18*a* in terms of the axial direction of the rocker arm shaft 14.

The first and second cams 15*a*, 16*a*, 15*b*, 16*b* include cylindrical zero lift faces F1 having the centers at the cam axis line C2 and the same diameter, and chevron lift faces F2 projecting toward the outer periphery with respect to the zero lift faces F1 at a predetermined rotational position (FIG. 4).

The timing cam 36 is has a cylindrical zero lift face F3 about the cam axis line C2 and a chevron lift face F4 projecting toward the outer periphery with respect to the zero lift face F3 at a predetermined rotational position.

When the zero lift faces F1 of the respective cams 15*a*, 16*a*, 15*b*, 16*b* oppose the cam sliding-contact portions 17*c*, 18*c* of the left and right rocker arms 17, 18, the intake valve 6 is fully closed (the amount of lift is zero) and assumes a valve-close state. When the lift faces F2 are in sliding contact with the cam sliding-contact portions 17*c*, 18*c*, the intake valve 6 is opened by a predetermined amount (lifted by the predetermined amount) and assumes a valve-open state.

When the zero lift face F3 of the timing cam 36 opposes a cam sliding-contact portion 33*d* of the timing arm 33, the timing arm 33 assumes a before-pivoting state (discussed later). When the lift face F4 comes in sliding contact with the cam sliding-contact portion 33*d* of the timing arm 33, the timing arm 33 assumes a pivoting state (discussed later).

The amounts of projection (the amount of lift) of the lift faces F2 of the first cams 15*a*, 16*a* of the left and right cam pairs 15A, 16A are smaller than those of the second cams 15*b*, 16*b*. The amounts of projection and the shapes of the lift faces F2 of the second cams 15*b*, 16*b* of the left and right cam pairs 15A, 16A are the substantially similar with respect to each other.

On the other hand, the amount of projection of the lift face F2 of the first cam 15*a* of the left cam pair 15A is smaller than that of the right cam pair 16A. Accordingly, the air-intake speed of the engine 1 in the low-speed rotation range is increased and the difference in amount of intake air when the cam is switched is increased, so that the change in air-intake characteristics is emphasized. The amount of lift of the first cam 15*a* of the left cam pair 15A may be set to zero, or the amounts of projection of the lift faces F2 of the first cams 15*a*, 16*a* may be set to be equal.

The left and right rocker arms 17, 18 are urged inwardly in the left and right directions with respect to the cylinder by first and second rocker arm moving mechanisms 21, 22, respectively (described later). The left and right rocker arms 17, 18 are supported on the rocker arm shaft 14 so as to be capable of moving integrally in the axial direction in a state in which the base portions 17*a*, 18*a* are in abutment with each other in the axial direction of the rocker arm shaft 14.

The left and right rocker arms 17, 18 are at the rightmost limit positions in the axial direction when an operation of the engine 1 is stopped or is operated in the low-speed rotation range. In such operational state, the cam sliding-contact portions 17*c*, 18*c* of the left and right rocker arms 17, 18 are arranged at positions being capable of coming into sliding contact with the outer peripheral surface (cam surface) below the first cams 15*a*, 16*a* of the left and right cam pair 15A, 16A respectively.

The valve pressing portions 17*d*, 18*d* of the left and right rocker arms 17, 18 are provided so as to be wider in the transverse direction than the cam sliding-contact portions 17*c*, 18*c*. The valve pressing portions 17*d*, 18*d* are arranged at positions where the left end portions thereof are capable of pressing the distal end portion of the stems 6*b* of the left and right intake valves 6 in a state in which the left and right rocker arms 17, 18 are at the rightmost limit positions. The rightmost limit positions of the left and right rocker arms 17, 18 in the axial direction are defined as a first operating position.

Referring to FIG. 3, the left and right rocker arms 17, 18 are at the leftmost limit positions in the axial direction when the engine 1 is operated in the high-speed rotation range. In this state, i.e., when the engine 1 is operated in the high-speed rotation range, the cam sliding-contact portions 17*c*, 18*c* of the left and right rocker arms 17, 18 are arranged at positions being capable of coming into sliding contact with the outer peripheral surface (cam surface) below the second cams 15*b*, 16*b* of the left and right cam pair 15A, 16A, respectively.

The valve pressing portions 17*d*, 18*d* of the left and right rocker arms 17, 18 are arranged at positions where the right end portions thereof are capable of pressing the distal end portion of the stems 6*b* of the left and right intake valves 6 in a state in which the left and right rocker arms 17, 18 are at the leftmost limit positions. The leftmost limit positions of the left and right rocker arms 17, 18 in the axial direction at this time are defined as a second operating position.

In other words, the variable valve actuating mechanism 5*a* is capable of selectively operating one of the pair of cams 15*a* and 16*a*, and 15*b* and 16*b* for opening and closing the left and right intake valves 6 by operating the first and second rocker arm moving mechanisms 21, 22 according to the number of revolutions of the engine and moving the left and right rocker arms 17, 18 to one of the first operating position and the second operating position in the axial direction of the rocker arm shaft 14.

The first rocker arm moving mechanism 21 includes a first spring 23 positioned on the right side of the base portion 18*a* of the right rocker arm 18. The first spring 23 provides a force from the first operating position (the side of the low-speed rotation) toward the second operating position (the side of the high-speed rotation) to the base portion 18*a* and a first spring receiving collar 25. The first spring receiving collar 25 is positioned on the right side of the first spring 23 so as to be supported by the outer periphery of the locker arm shaft 14 and so as not to be capable of relatively moving in the axial direction thereof.

Further, in the similar manner, the second rocker arm moving mechanism 22 includes a second spring 24 positioned on the left side of the base portion 17*a* of the left rocker arm 17. The second spring 24 provides a force from the second operating position toward the first operating position to the base portion 17*a* and a second spring receiving collar 26. The second spring receiving collar 26 positioned on the left side of the second spring 24 so as to be supported by the outer periphery of the locker arm shaft 14 and so as not to be capable of relatively moving in the axial direction thereof.

The springs 23, 24 are compression coil springs which wind the outer periphery of the rocker arm shaft 14 (i.e., the rocker arm shaft 14 through the springs 23, 24). The left end portion of the first spring 23 is fitted to the outer periphery on the right side of the base portion 18*a* of the right rocker arm 18, and the right end portion of the first spring 23 is fitted to the inner periphery of the left portion of the first spring receiving collar 25. On the other hand, the right end portion of the second spring 24 is fitted to the outer periphery of the left side of the base portion 17*a* of the left rocker arm 17, and the left end portion of the second spring 24 is fitted to the inner periphery of the right portion of the second spring receiving collar 26.

Here, the rocker arm shaft 14 is pivotally supported by the cylinder head 2 so as to be capable of moving in the axial direction, and is capable of reciprocating with respect to the cylinder head 2 in the axial direction by the operation of a shaft drive mechanism 41 (described later)

The rocker arm shaft 14 and the spring receiving collars 25, 26 are at the rightmost limit positions in the axial direction when the engine 1 is stopped or operated in the low-speed rotation range (see FIG. 2). At this time, the left and right rocker arms 17, 18 are at the first operating position, and the springs 23, 24 are provided between the base portions 17*a*, 18*a* of the left and right rocker arms 17, 18 and the spring receiving collars 25, 26 in a state of being compressed initially by a predetermined extent. The initial loads, which the springs 23, 24 have at this time, are the same, and hence the left and right rocker arms 17, 18 are retained in the first operating position.

Simultaneously, the leftward movement of the left rocker arm 17 is restrained by the timing arm 33 of the rocker arm movement restraining mechanism 31, and the leftward movement of the right rocker arm 18 is restrained by a first claw member 34 (also referred as a second arm member 34) of the rocker arm movement restraining mechanism 31.

On the other hand, referring to FIG. 3, the rocker arm shaft 14 and the spring receiving collars 25, 26 are at the leftmost limit positions in the axial direction when the engine 1 is operated in the high-speed rotation range. At this time, the left and right rocker arms 17, 18 are at the second operating position, and the springs 23, 24 are provided between the base portions 17*a*, 18*a* of the left and right rocker arms 17, 18 and the spring receiving collars 25, 26 in a state of being applied with initial compression, as discussed above. The initial loads that the springs 23, 24 have are the substantially equal with respect to each other, and hence the left and right rocker arms 17, 18 are retained in the second operating position.

Simultaneously, the rightward movement of the left rocker arm 17 is restrained by the timing arm 33 of the rocker arm movement restraining mechanism 31, and also by a second claw member 35 (also referred as a second arm member 35) of the rocker arm movement restraining mechanism 31.

The amount of movement in the axial direction of the rocker arm shaft 14 and the spring receiving collars 25, 26 is the same as the amount of movement in the axial direction of the left and right rocker arms 17, 18 (the amount of movement between the respective operating positions).

Then, the rocker arm shaft 14 and the spring receiving collars 25, 26 are moved integrally with the cylinder head 2 in the axial direction in a state in which axial movement of the left and right rocker arms 17, 18 with respect to the cylinder head 2 is restrained by the timing arm 33 and the claw members 34, 35 (also referred as second arm members 34, 35) of the rocker arm movement restraining mechanism 31, so that a predetermined difference in elasticity is generated between the springs 23, 24.

More specifically, the rocker arm shaft 14 and the spring receiving collars 25, 26 are moved from the rightmost limit position toward the leftmost limit position with respect to the cylinder head 2 in a state in which the leftward movement of the left and right rocker arms 17, 18 is restrained by the timing arm 33 and the first claw member 34, so that the first spring 23 is compressed by an amount corresponding to the movement to increase the elasticity and, simultaneously, the second spring 24 is expanded to reduce the elasticity.

On the other hand, the rocker arm shaft 14 and the spring receiving collars 25, 26 are moved from the leftmost limit position toward the rightmost limit position with respect to the cylinder head 2 in a state in which the rightward movement of the left and right rocker arms 17, 18 is restrained by the timing arm 33 and the second claw member 35, so that the second spring 24 is compressed by an amount corresponding to the movement to increase the elasticity and, simultaneously, the first spring 23 is expanded to reduce the elasticity.

In this manner, movement of the left and right rocker arms 17, 18 from one of the first and second operating position toward the other of the first and second operating position is achieved using the difference in elasticity between the springs 23, 24 (which means elasticity accumulated in either one of the springs 23, 24, hereinafter). The amount of expansion of the springs 23, 24 corresponds to the amount of the initial compression.

As shown in FIGS. 2-4, the rocker arm movement restraining mechanism 31 restrains the axial movement of the left and right rocker arms 17, 18 until a predetermined elasticity is accumulated in one of the springs 23, 24.

The rocker arm movement restraining mechanism 31 includes the timing arm 33 supported by the cylinder head 2 via a supporting shaft 32 extending in parallel to the rocker arm shaft 14 so as to be capable of pivoting about the supporting shaft 32, and so as not to be capable of moving in the axial direction. The rocker arm movement restraining mechanism 31 also includes and the first and second claw members 34, 35 supported by the cylinder head 2 via supporting shafts 34*a*, 35*a* extending orthogonally to the rocker arm shaft 14. The claw members 34, 35 are pivotally disposed on the supporting shafts 34*a*, 35*a* respectively behind the base portions 17*a*, 18*a* of the left and right rocker arms 17, 18 on the left and right outsides of the left and right cam pairs 15A, 16A.

The timing arm 33 extending in the vertical direction behind the intake-side camshaft 11, and the upper end portion thereof is positioned at obliquely upper rear position of the intake-side camshaft 11. The supporting shaft 32 is passed through the upper end portion (base portion 33*a*). A plate-shaped arm portion 33*b* orthogonal to the cam axis line C2 extends downward from the base portion 33*a* of the timing arm 33.

The arm portion 33*b* of the timing arm 33 extends downward until the distal end portion thereof reaches a position in the vicinity of the locker arm shaft 14. The distal end portion of the arm portion 33*b* is a hook portion 33*c* having a U-shape in side view opening toward the front. The hook portion 33*c* is engagable with one of the base portions 17*a*, 18*a* of the left and right rocker arms 17, 18 from behind.

The timing arm 33 is urged to the side, and upon such urging, the hook portion 33*c* is engaged with the left and right rocker arms 17, 18 (rightward in FIG. 4, in a clockwise direction), The axial movement of the left and right rocker arms 17, 18 is restrained in a state in which the hook portion 33*c* of the timing arm 33 is engaged with one of the left and right rocker arms 17, 18. The state of the timing arm 33 at this time is defined as a before-pivoting state of the timing arm 33.

The arm portion 33*b* of the timing arm 33 is includes a forwardly protruded curved shape in side view (the side of the intake-side camshaft 11), and also includes the cam sliding-contact portion 33*d* on which the timing cam 36 of the intake-side camshaft 11 can slide on the front side of the mid-section portion thereof.

When the intake-side camshaft 11 rotates, and the lift face F4 of the timing cam 36 comes in sliding contact with the cam sliding-contact portion 33*d* of the timing arm 33 at a predetermined timing, the timing arm 33 pivots leftward (i.e., in a counterclockwise direction) against the urging force and moves the hook portion 33*c* rearward to release engagement with respect to the left and right rocker arms 17, 18.

Accordingly, in a period from immediately after the respective cams close the intake valve 6 until the intake valve 6 starts to open (a period when the amount of lift of the valve is zero or of a minute amount), the restraint of the axial movement of the left and right rocker arms 17, 18 by the timing arm 33 is released, and the axial movement of the left and right rocker arms 17, 18 is enabled. The state of the timing arm 33 at this time is defined as a pivoting state of the timing arm 33.

A flange 19 having a larger diameter than the base portion 17*a* is provided integrally with the left rocker arm 17 on the right side of the base portion 17*a*. The flange 19 has a wall which is orthogonal in the left and right directions, and has an annular shape extending the entire circumference of the base portion 17*a* having a predetermined transverse width. The left and right rocker arms 17, 18 are integrally held in a state in which the left side surface of the base portion 18*a* of the right rocker arm 18 abuts the right side surface of the flange 19.

When the left and right rocker arms 17, 18 are at the first operating positions, the hook portion 33*c* of the timing arm 33 comes into contact with the left side of the flange 19 and engages the base portion 17*a* of the left rocker arm 17 (see FIG. 2). When the left and right rocker arms 17, 18 are at the second operating position, the hook portion 33*c* of the timing arm 33 comes into contact with the right side of the flange 19 and engages the base portion 18*a* of the right rocker arm 18 (see FIG. 3). In other words, the transverse width of the flange 19 corresponds to the amount of movement between the operating positions of the left and right rocker arms 17, 18.

First and second engaging projections 17*e*, 18*e* with which the first and second claw members 34, 35 are respectively engageable are integrally disposed at the ends of the base portions 17*a*, 18*a* of the left and right rocker arms 17, 18 coming into contact with the respective springs 23, 24.

In a state in which the left and right rocker arms 17, 18 are at the first operating position, the first claw member 34 engages the second engaging projection 18*e*, so that leftward movement of the right rocker arm 18 (and hence the left and right rocker arms 17, 18) is restrained. At this time, the right base portion 18*a* is adjacent to a first stopper wall 2*b* of the cylinder head 2 on the left side, so that rightward movement of the right rocker arm 18 (and hence the left and right rocker arms 17, 18) is also restrained.

On the other hand, in a state in which the left and right rocker arms 17, 18 are at the second operating position, the second claw member 35 engages the first engaging projection 17*e*, so that rightward movement of the left rocker arm 17 (and hence the left and right rocker arms 17, 18) is restrained. At this time, the left base portion 17*a* is adjacent to a second stopper wall 2*c* of the cylinder head 2 on the right side, so that leftward movement of the left rocker arm 17 (and hence the left and right rocker arms 17, 18) is also restrained.

The first and second claw members 34, 35 extend from the base portion which allows passage of the supporting shafts 34*a*, 35*a* therethrough toward the center of the cylinder. The first and second claw members 34, 35 include respective first and second locking claws 34*b*, 35*b* for engagement with the first and second engaging projections 17*e*, 18*e* of the rocker arms 17, 18, respectively on the front side of the distal end portions thereof. The first and second claw members 34, 35 also include first and second trigger claws 34*c*, 35*c*, respectively, for releasing engagement with the first and second engaging projections 17*e*, 18*e* of the rocker arms 17, 18, respectively, on the front side of the midsections thereof.

As shown inn FIGS. 2 and 3, the claw members 34, 35 are urged toward positions where the locking claws 34*b*, 35*b* engage the engaging projections 17*e*, 18*e* respectively (the first claw member 34 is urged clockwise direction, and the second claw member 35 is urged counterclockwise direction).

Subsequently, as discussed above, in the state in which the left and right rocker arms 17, 18 are at the first or second operating positions, one of the claw members 34, 35 engages the corresponding engaging projection 17*e* or 18*e*, so that the axial movement of the left and right rocker arms 17, 18 is restrained. The states of the respective claw members 34, 35 at this time are defined as the before-pivoting states of the claw members 34, 35, respectively.

When the rocker arm shaft 14 and the spring receiving collars 25, 26 are at the rightmost limit position, the trigger claw 35*c* climbs over the second spring receiving collar 26, so that the second claw member 35 pivots clockwise direction (as shown in FIGS. 2 and 3) against the urging force and releases engagement with the first engaging projection 17*e*.

On the other hand, the trigger claw 34*c* climbs over the first spring receiving collar 25 when the rocker arm shaft 14 and the spring receiving collars 25, 26 are at the leftmost limit position, so that the first claw member 34 pivots in a counterclockwise direction (as shown in FIGS. 2 and 3) against the urging force and releases engagement with the second engaging projection 18*e*.

In other words, the claw members 34, 35 are capable of switching engaging state respectively with respect to the engaging projections 17*e*, 18*e* in association with the movement of the spring receiving collars 25, 26. Hereinafter, a state in which the claw members 34, 35 are pivoted and are released from engagement with the engaging projections 17*e*, 18*e*, as discussed above, is designated as the pivoting state of the claw members 34, 35.

The locking claws 34*b*, 35*b* are respectively disposed on inclined sides on the front side of the distal ends thereof, and when the engaging projections 17*e*, 18*e* are in the proximity to the locking claws 34*b*, 35*b*, and the inclined sides come into sliding contact therewith, the locking claws 34*b*, 35*b* climb thereover so that the claw members 34, 35 are pivoted against the urging force and hence the engaging projections 17*e*, 18*e* are capable of moving to predetermined engaging positions.

The trigger claws 34*c*, 35*c* are respectively disposed on inclined sides on the front side of the distal ends of the claws 34, 35. When the spring receiving collars 25, 26 are in the proximity to the trigger claws 34*c*, 35*c*, and the inclined sides come into sliding contact therewith, then the trigger claws 34*c*, 35*c* climb thereover, so that the claw members 34, 35 are pivoted against the urging force to release engagement with the engaging projections 17*e*, 18*e*.

Figure 5:
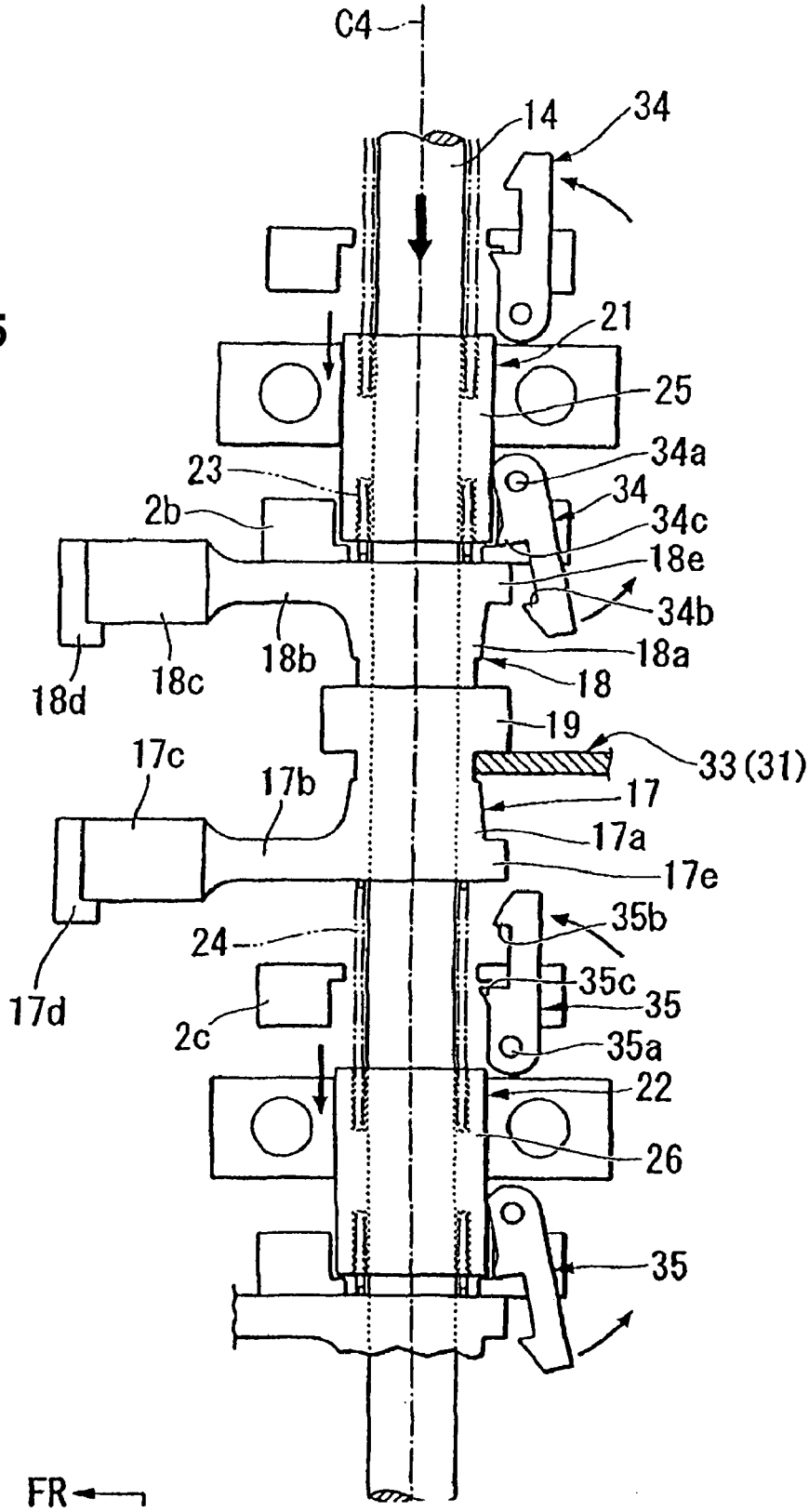
FIG. 5 is a top view corresponding to FIG. 2 showing a first operation of the variable valve actuating mechanism.

When the left and right rocker arms 17, 18 are at the first operating position and a predetermined force is accumulated in the first rocker arm moving mechanism 21 in order to move the left and right rocker arms 17, 18 to the second operating position, the shaft drive mechanism 41 is activated first, and the rocker arm shaft 14 at the rightmost limit position is moved leftward together with the spring receiving collars 25, 26 as shown in FIG. 5.

At this time, if the first spring receiving collar 25 does not yet reach the leftmost limit position, the first claw member 34 is kept in engagement with the first engaging projection 17*e* of the right rocker arm 18, and leftward movement of the right rocker arm 18 is restrained by the first claw member 34.

When the first spring receiving collar 25 is moved to the leftmost limit position, the first spring 23 is compressed by a predetermined amount between the first spring receiving collar 25 and the base portion 18*a* of the right rocker arm 18, and the first spring 23 is brought into a state of having elasticity which can move the left and right rocker arms 17, 18 from the first operating position toward the second operating position.

At this time, when the trigger claw 34*c* of the first claw member 34 climbs over the end portion of the first spring receiving collar 25, and the first claw member 34 is pivoted in a counterclockwise direction (as shown in FIG. 5), engagement of the locking claw 34*b* with the second engaging projection 18*e* is released, and restraint of leftward movement of the right rocker arm 18 at the corresponding portion is released. At this time, the second spring receiving collar 26 is moved leftward and hence climbing of the trigger claw 35*c* over the end portion of the second spring receiving collar 26 is released, so that the second claw member 35 is returned from the pivoting state to the before-pivoting state.

Figure 7B:
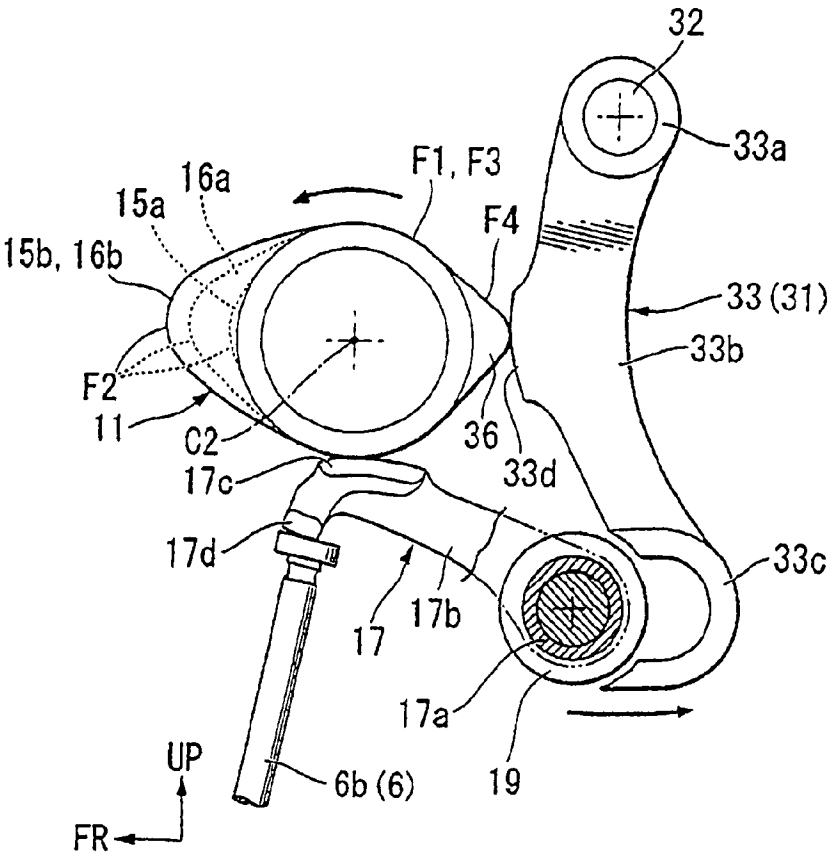
FIG. 7B is a cross-sectional view corresponding to FIG. 4 showing a fourth operation of variable valve actuating mechanism.
Figure 7A:
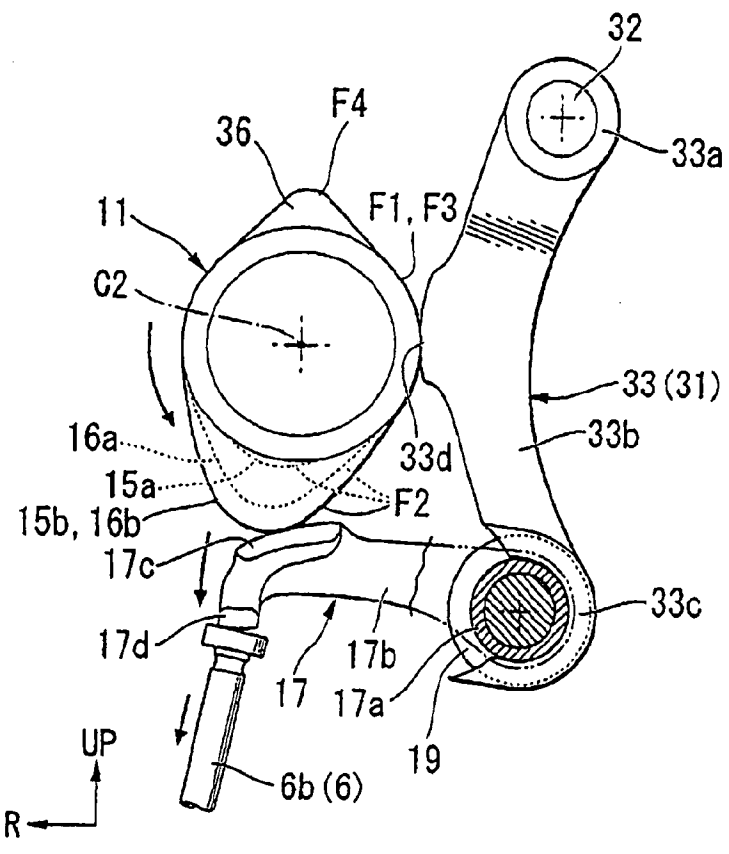
FIG. 7A is a cross-sectional view corresponding to FIG. 4 showing a third operation of the variable valve actuating mechanism.

In a state in which the restraint of leftward movement of the right rocker arm 18 by the first claw member 34 is released, as described above, if the timing arm 33 is in a state in which the hook portion 33*c* thereof is engaged with the base portion 17*a* of the left rocker arm 17 as shown in FIG. 7A, then the hook portion 33*c* comes in contact with the flange 19 from the left side, and restrains leftward movement of the left rocker arm 17 (and hence the left and right rocker arms 17, 18).

On the other hand, as shown in FIG. 7B, at a predetermined valve timing, if the timing cam 36 comes in sliding contact with the cam sliding-contact portion 33*d* of the timing arm 33 to pivot the timing arm 33 counterclockwise direction so that engagement of the hook portion 33*c* with respect to the left rocker arm 17 is released, then restraint of leftward movement of the left rocker arm 17 (and hence the left and right rocker arms 17, 18) at the corresponding portion is also released, so that the left and right rocker arms 17, 18 are movable from the first operating position toward the second operating position.

The timing of movement (the pivoting timing of the timing arm 33) is the timing when the intake valve 6 is fully closed, a reaction force against pressing from the intake valve 6 affects the left and right rocker arms 17, 18 little, and hence the left and right rocker arms 17, 18 can be moved smoothly.

Before the restraint of leftward movement of the right rocker arm 18 by the first locking claw 34*b* is released (before a predetermined elasticity is accumulated in the first spring 23), even when the timing arm 33 is pivoted at the predetermined valve timing, the left and right rocker arms 17, 18 do not move leftward.

When the left rocker arm 17 is moved leftward, the locking claw 35*b* of the second claw member 35 climbs over the first engaging projection 17*e*, so that the pivoting state is assumed. Simultaneously, after the first engaging projection 17*e* is moved to the predetermined engaging position, it returns to the before-pivoting state, where the locking claw 35*b* is engaged with the first engaging projection 17*e*.

At this time, the left and right rocker arms 17, 18 are at the leftmost limit position, and hence leftward movement of the left rocker arm 17 is restrained by the second stopper wall 2*c* and rightward movement of the left rocker arm 17 is restrained by the second claw member 35.

Further, the timing arm 33 is capable of engaging the base portion 18*a* of the right rocker arm 18 at a position where it comes in contact with the right side of the flange 19. Rightward movement of the right rocker arm 18 is restrained by elasticity of the first spring 23.

Figure 6:
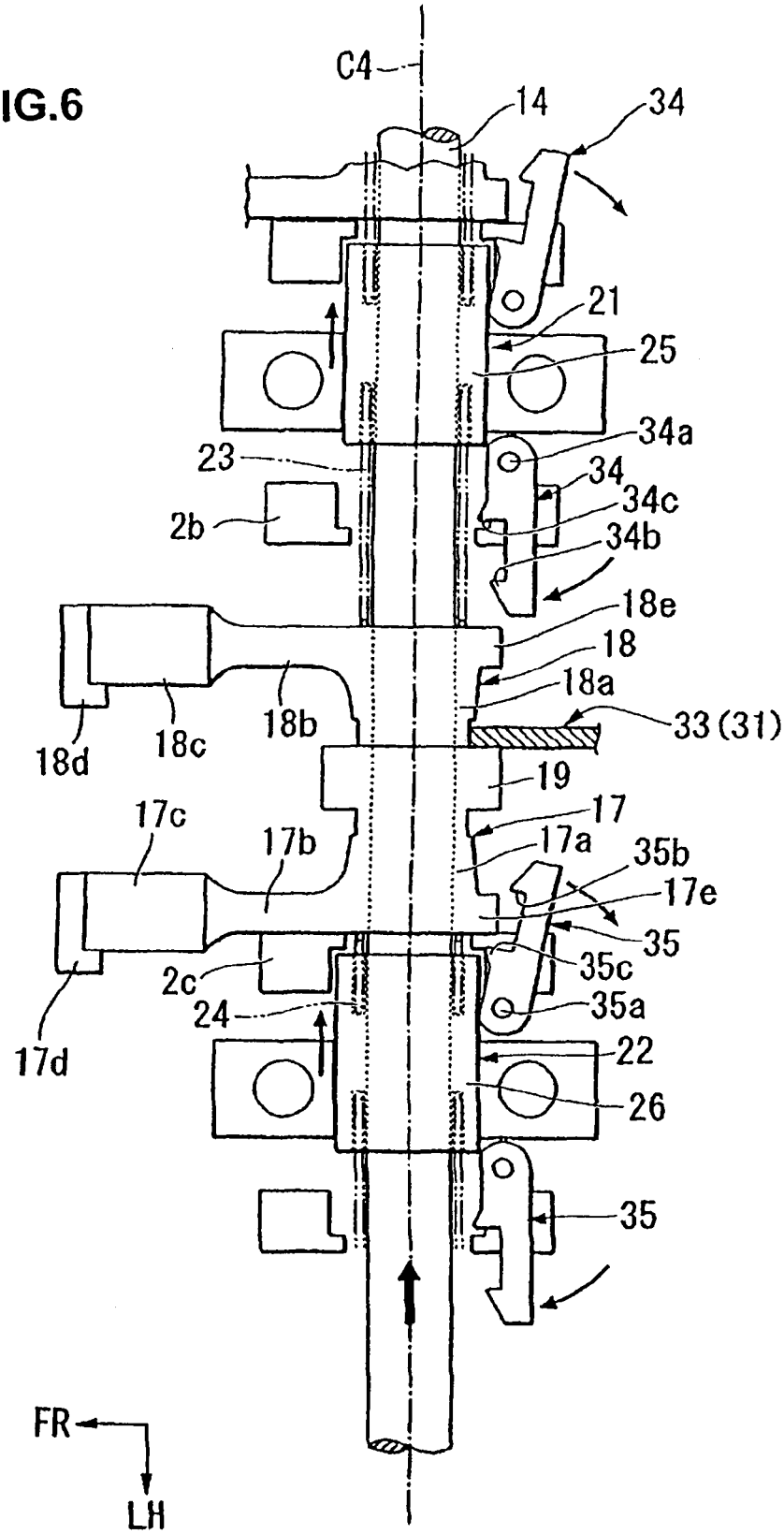
FIG. 6 is a top view corresponding to FIG. 2 showing a second operation of the variable valve actuating mechanism.

When the left and right rocker arms 17, 18 are at the second operating position and a predetermined force is accumulated in the second rocker arm moving mechanism 22 in order to move the left and right rocker arms 17, 18 to the first operating position, the shaft drive mechanism 41 is activated first, and the rocker arm shaft 14 at the leftmost limit position is moved rightward together with the spring receiving collars 25, 26, as shown in FIG. 6.

At this time, if the second spring receiving collar 26 does not yet reach the rightmost limit position, the second claw member 35 is kept in engagement with the second engaging projection 18*e* of the left rocker arm 17, and rightward movement of the left rocker arm 17 is restrained by the second claw member 35.

When the second spring receiving collar 26 is moved to the rightmost limit position, the second spring 24 is compressed by a predetermined amount between the second spring receiving collar 26 and the base portion 17*a* of the left rocker arm 17, and the second spring 24 is brought into a state of having elasticity which can move the left and right rocker arms 17, 18 from the second operating position toward the first operating position.

At this time, when the trigger claw 35*c* of the second claw member 35 climbs over the end portion of the second spring receiving collar 26, and the second claw member 35 is pivoted clockwise (as shown in FIG. 6), engagement of the locking claw 35*b* with the first engaging projection 17*e* is released, and restraint of rightward movement of the left rocker arm 17 at the corresponding portion is also released. At this time, the first spring receiving collar 25 is moved rightward and hence climbing of the trigger claw 34*c* over the end portion of the first spring receiving collar 25 is released, so that the first claw member 34 is returned from the pivoting state to the before-pivoting state.

In a state in which the restraint of rightward movement of the left rocker arm 17 by the second claw member 35 is released, as described above, if the timing arm 33 is in a state in which the hook portion 33*c* thereof is engaged with the base portion 18*a* of the right rocker arm 18 (as shown in FIG. 7A), the hook portion 33*c* comes into contact with the flange 19 from the right side, and restrains rightward movement of the left rocker arm 17 (and hence also that of right rocker arm 18).

On the other hand, as shown in FIG. 7B, at a predetermined valve timing, if the timing cam 36 comes in sliding contact in contact with the cam sliding-contact portion 33*d* of the timing arm 33 to pivot the timing arm 33 so that engagement of the hook portion 33*c* with respect to the right rocker arm 18 is released, then restraint of rightward movement of the left rocker arm 17 (and hence the left and right rocker arms 17, 18) at the corresponding portion is also released, so that the left and right rocker arms 17, 18 are movable from the second operating position towards the first operating position.

The timing of movement (the pivoting timing of the timing arm 33) is the timing when the intake valve 6 is fully closed, a reaction force against pressing from the intake valve 6 affects the left and right rocker arms 17, 18 little, and hence the left and right rocker arms 17, 18 can be moved smoothly.

Before the restraint of rightward movement of the left rocker arm 17 by the second locking claw 35*b* is released (before the predetermined elasticity is accumulated in the second spring 24), even when the timing arm 33 is pivoted at the predetermined valve timing, the left and right rocker arms 17, 18 do not move rightward.

When the right rocker arm 18 is moved rightward, the locking claw 34*b* of the first claw member 34 climbs over the second engaging projection 18*e*, so that the pivoting state is assumed. Simultaneously, after the second engaging projection 18*e* is moved to the predetermined engaging position, it returns to the before-pivoting state, where the locking claw 34*b* is engaged with the second engaging projection 18*e*.

At this time, the left and right rocker arms 17, 18 are at the leftmost limit position, and hence leftward movement of the right rocker arm 18 is restrained by the first stopper wall 2*b* and leftward movement of the right rocker arm 18 is restrained by the first claw member 34.

At this time, the timing arm 33 is capable of engaging the base portion 17*a* of the left rocker arm 17 at a position where it comes into contact with the left side of the flange 19. A leftward movement of the left rocker arm 17 is restrained by elasticity of the second spring 24 in addition to the timing arm 33.

Accordingly, the timing to open and close the intake valve 6 and the amount of lift of the valve are varied (i.e., lift is variable) as needed between the case in which the number of revolutions of the engine 1 (the number of revolutions of the crankshaft) is zero or in the low-speed rotation range. The amount of lift is held down in the low-speed rotation range of the engine 1, and the valve overlap is increased. When the engine is in the high-speed rotation range, the valve overlap is reduced, and the amount of lift is increased. A variable valve actuating mechanism 5*a* of the same configuration may be applied on the exhaust side of the engine 1 as a matter of course and, in this case, the efficiency of air intake and exhaust is enhanced in the respective rotation ranges of the engine 1.

Figure 8:
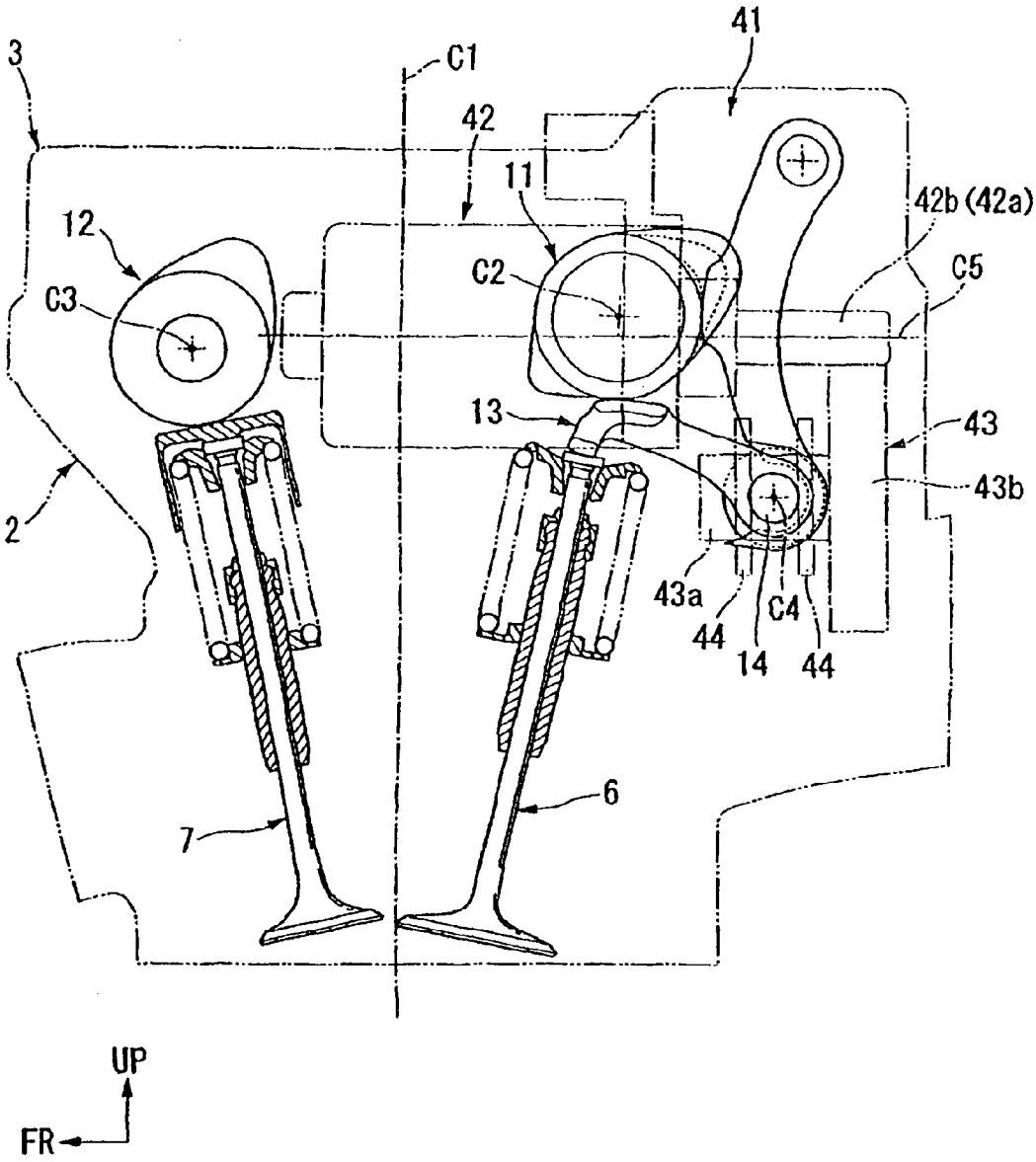
FIG. 8 is a left side view corresponding to FIG. 1 showing a shaft drive mechanism of the variable valve actuating mechanism.
Figure 9:
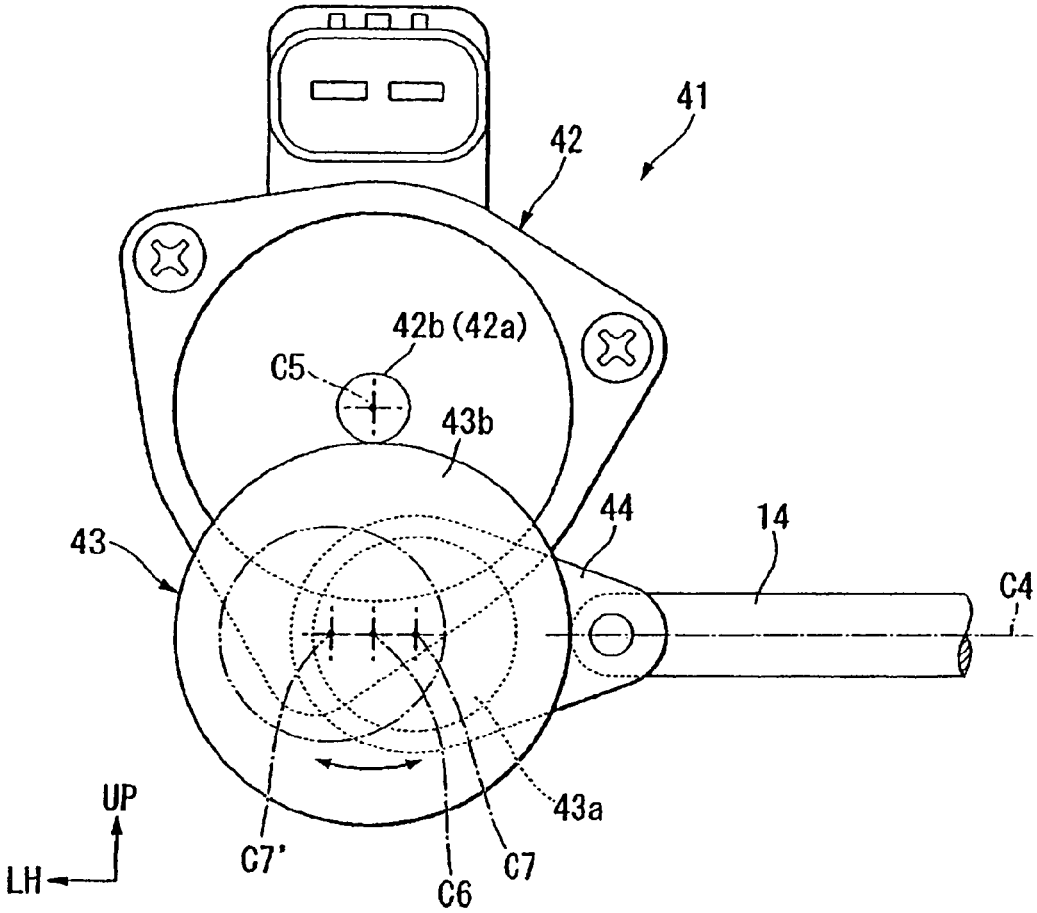
FIG. 9 is a back view of the principal portion of the shaft drive mechanism.

As shown in FIGS. 8 and 9, the shaft drive mechanism 41 includes a drive source 42 (e.g., an electric motor 42), a speed-reduction gear shaft 43 arranged in parallel to a drive shaft 42*a* of the electric motor 42, and a connecting rod 44 for connecting a concentric shaft 43*a* of the speed-reduction gear shaft 43 and one end of the rocker arm shaft 14.

The electric motor 42 is mounted to a left (or right) side surface of the cylinder head 2. The electric motor 42 is arranged on the side surface of the cylinder head such that a drive axis line C5 extends orthogonally to the cylinder axis line C1 in side view. A drive gear 42*b* is disposed on the outer periphery of the drive shaft 42*a* of the electric motor 42. The drive gear 42*b* engages a large-diameter gear 43*b* on the side of one end of the speed-reduction gear shaft 43.

A rotational drive force of the electric motor 42 is reduced and transmitted to the speed-reduction gear shaft 43 via the respective gears 42*b*, 43*b* and the concentric shaft 43*a* of the speed-reduction gear shaft 43. The speed-reduction gear shaft 43 is disposed extending left-right direction such that the single rocker arm shaft 14 extending across the respective cylinders of the engine 1 strokes in the left and right direction (axial direction).

In FIG. 9, a reference numeral C6 designates a center axis line of the speed-reduction gear shaft 43 when the rocker arm shaft 14 is moved rightward, reference numeral C7 designates a center axis line of the concentric shaft 43*a* when the rocker arm shaft 14 is moved rightward, and reference numeral C7' designates a center axis line of the concentric shaft 43*a* when the rocker arm shaft 14 is moved leftward.

As described above, the valve actuating mechanism 5 includes the intake-side camshaft 11 having a pair of first cams 15*a*, 16*a* and the second cams 15*b*, 16*b* for each intake valve 6, and the left and right rocker arms 17, 18 pivotally supported on the rocker arm shaft 14 extending in parallel to the intake-side camshaft 11. The right rocker arms 17, 18 are movable in the axial direction of the rocker arm shaft 14.

The left and right rocker arms 17, 18 come in contact with one of the cams 15*a*, 16*a*, 15*b*, 16*b* and hence pivot to open and close the intake valve 6 according to the rotation of the intake-side camshaft 11. The left and right rocker arms 17, 18 move in the axial direction to one of the first operating position and the second operating position. In the first operating position, the left and right rocker arms 17, 18 come into contact with the first cams 15*a*, 16*a*. In the second operating position, the left and right rocker arms 17, 18 come into contact with the second cams 15*b*, 16*b*.

During operation of the valve actuating mechanism 5, selected ones of the cams 15*a*, 16*a*, 15*b*, 16*b* are used for opening and closing operation of the intake valve 6. The first rocker arm moving mechanism 21 moves the left and right rocker arms 17, 18 from the first operating position toward the second operating position. The second rocker arm moving mechanism 22 moves the left and right rocker arms 17, 18 from the second operating position toward the first operating position. The rocker arm movement restraining mechanism 31 restrains the movement of the left and right rocker arms 17, 18 in the axial direction.

The valve actuating mechanism 5 according to the present invention is characterized in that the rocker arm movement restraining mechanism 31 includes the timing arm 33 which engages the left and right rocker arms 17, 18 for restraining the axial movement thereof, and the timing cam 36 provided on the intake-side camshaft 11 which activates the timing arm 33 and releases the engagement of the timing arm 33 with the left and right rocker arms 17, 18 by activating the timing arm 33 when the intake-side camshaft 11 is rotated. The timing arm 33 releases the engagement with the left and right rocker arms 17, 18 when the intake valve 6 is closed so that the left and right rocker arms 17, 18 move to the corresponding operating position by one of the rocker arm moving mechanisms 21, 22.

In this configuration, restraint of the movement and release of the left and right rocker arms 17, 18 are mechanically switched according to the state of the rotation of the intake-side camshaft 11, that is, depending on whether the intake valve 6 is opened or closed, so that the movement of the left and right rocker arms 17, 18 depending on whether the intake valve 6 is opened or closed is enabled. In particular, the movement of the left and right rocker arms 17, 18 in a state in which the intake valve 6 is closed is enabled.

Therefore, a force required for moving the left and right rocker arms 17, 18 in the axial direction is substantially reduced. In addition, an electrical sensor or control for detecting whether the intake valve 6 is opened or closed is not required, so that the valve actuating mechanism itself may be simplified.

Furthermore, in the engine having a plurality of cylinders, the timing of movement of the left and right rocker arms 17, 18 may be set for each cylinder by providing the timing arm 33 for each cylinder, so that the valve drive cam may be switched at timings optimal for each cylinder.

According to the valve actuating mechanism 5 of the present invention, the timing arm 33 engages the flange 19 provided on the base portion 17*a* of the left rocker arm 17, which allows passage of the rocker arm shaft 14 therethrough, so that the restraint of the movement of the left and right rocker arms 17, 18 in the axial direction may be carried out simply and reliably.

According to the valve actuating mechanism 5 of the present invention, a force for moving the left and right rocker arms 17, 18 of the rocker arm moving mechanisms 21, 22 in the axial direction is applied to the base portions 17*a*, 18*a* of the left and right rocker arms 17, 18, which allow passage of the rocker arm shaft 14 therethrough. Such arrangement of the valve actuating mechanism smoothens the movement of the left and right rocker arms 17, 18 in the axial direction. With a configuration in which the timing arm 33 engages the base portions 17*a*, 18*a* (flange 19) of the left and right rocker arms 17, 18 which receives a force from the rocker arm moving mechanisms 21, 22, the timing arm 33 receives the force from the rocker arm moving mechanisms 21, 22 at high efficiency.

In addition, the valve actuating mechanism 5 of the present invention is characterized in that the rocker arm moving mechanisms 21, 22 include the first and second springs 23, 24 which are engaged at one ends thereof with the base portions 17*a*, 18*a* of the left and right rocker arms 17, 18. The first and second springs 23, 24 allow passage of the rocker arm shaft 14 therethrough and provide a force in the axial direction thereto. The first and second spring receiving collars 25, 26 are supported on the outer periphery of the rocker arm shaft 14 and engage the other ends of the springs 23, 24. The first and second spring receiving collars 25, 26 substantially fixed in position since they do not move relatively in the axial direction.

The rocker arm movement restraining mechanism 31 includes the first and second claw members 34, 35 for restraining the axial movement of the left and right rocker arms 17, 18 until the predetermined force is accumulated in one of the springs 23, 24.

The rocker arm shaft 14 is supported by the cylinder head 2 so as to be movable in the axial direction thereof. The rocker arm shaft 14 moves in the axial direction with respect to the cylinder head 2 together with the spring receiving collars 25, 26 in a state in which one of the claw members 34, 35 restrains the axial movement of the left and right rocker arms 17, 18 with respect to the cylinder head 2 so that the predetermined force is accumulated in either one of the springs 23, 24, and either one of the spring receiving collars 25, 26 comes in contact with one of the claw members 34, 35 in a state in which one of the spring receiving collars 25, 26 restrains the movement of the left and right rocker arms 17, 18 so that the restraint of movement of the left and right rocker arms 17, 18 by one of the claw members 34, 35 is released at a moment when the predetermined force is accumulated.

In this configuration, one of the springs 23, 24 is compressed to accumulate the predetermined force by moving the rocker arm shaft 14 in the axial direction together with the spring receiving collars 25, 26 and the restraint of movement of the left and right rocker arms 17, 18 by one of the claw members 34, 35 is released in association with the movement of the spring receiving collars 25, 26, so that the left and right rocker arms 17, 18 are prevented from moving before the rocker arm moving mechanisms 21, 22 accumulate the predetermined force, whereby quick and reliable movement of the left and right rocker arms 17, 18 is achieved.

The present invention is not limited to the above-described illustrative embodiments. For example, the present invention may include an embodiment having a configuration in which the timing arm 33 engages across the left and right rocker arms 17, 18 to restrain the movement thereof. A configuration in which the rocker arm moving mechanisms 21, 22 restrain the operation until the springs 23, 24 accumulate the predetermined force may be employed instead of the configuration in which the movement of the left and right rocker arms 17, 18 is restrained using the claw members 34, 35.

Furthermore, a configuration in which only the spring receiving collars 25, 26 move as needed to accumulate the force in the springs 23, 24 may be employed instead of the configuration in which the rocker arm shaft 14 moves in the axial direction.

The engine to which the invention is applied is not limited to a four-valve system, and may be of a two-valve system or a three-valve system, and may be of a single cylinder having a single rocker arm which cannot be pivoted relatively to intake and exhaust sides. The engine is not limited to DOHC engine, and may be OHC or OHV engine. The engine may be parallel multi-cylinder engine other than four-cylinder, or a single-cylinder engine, or may be of a reciprocal engine of various types, such as a V-type multi-cylinder engine.

The configuration described in the embodiment shown above is only an example of the invention, and may be modified variously without departing the scope of the invention.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A valve actuating mechanism for an engine, said engine comprising a cylinder having a plurality of intake valves;

a camshaft having a first cam and a second cam for each of said intake valves, respectively;

a rocker arm shaft extending parallel to the camshaft;

a pair of rocker arms supported on the rocker arm shaft; said rocker arms being rockable about the rocker arm shaft and being movable in the axial direction thereof, the rocker arms being configured to be selectively contacted by one of the first or second cams to open and close the valves according to a rotational movement of the camshaft; and said rocker arms being movable in the axial direction to one of a first operating position in which the rocker arms come in contact with the first cams, and a second operating position in which the rocker arms come in contact with the second cams such that the one of the cams selectively opens and closes the valves;

said valve actuating mechanism comprising:

a first rocker arm moving device which moves said rocker arms from the first operating position toward the second operating position;

a second rocker arm moving device which moves said rocker arms from the second operating position toward the first operating position; and a rocker arm movement restraining device which restrains the movement of said rocker arms in the axial direction;

wherein the rocker arm movement restraining device comprises:

an arm member which engages said rocker arms for restraining the axial movement thereof; and a third cam disposed on the camshaft for activating said arm member and releasing the engagement of the rocker arms with the arm member when the camshaft is rotated; and wherein said arm member releases the engagement thereof with the rocker arms when the valves are closed, such that the rocker arms are moved to the corresponding operating position by one of the first rocker arm moving device and the second rocker arm moving device.

2. A valve actuating mechanism of an engine according to claim 1, wherein one of said rocker arms comprises a base portion and a flange disposed on the base portion; wherein the arm member engages the flange disposed on the base portion of one of said rocker arms thereby allowing passage of said rocker arm shaft therethrough.

3. A valve actuating mechanism of an engine according to claim 1, wherein each of said rocker arms comprises a base portion; and wherein a force is applied in the axial direction to the base portions of the rocker arms to move said rocker arms so as to allow movement of said rocker arm shaft therethrough.

4. A valve actuating mechanism of an engine according to claim 2, wherein other of said rocker arms comprises a base portion; and wherein a force is applied in the axial direction to the base portions of the rocker arms to move said rocker arms so as to allow movement of said rocker arm shaft therethrough.

5. A valve actuating mechanism of an engine according to claim 1, wherein:

each of said rocker arms comprises a base portion;

said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by an engine structure so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

6. A valve actuating mechanism of an engine according to claim 2, wherein:

the other of the said rocker arms comprises a base portion;

said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by an engine structure so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

7. A valve actuating mechanism of an engine according to claim 3, said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by an engine structure so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

8. A valve device for an engine, said engine comprising a cylinder head having a first and second intake valves; a camshaft having a pair of first and second cams operatively associated with respective one of said first and second intake valves, said valve device comprising:

a rocker arm shaft extending parallel to the camshaft;

a left and a right rocker arms supported on the rocker arm shaft;

said rocker arms operable to open and close the one of said first and second intake valves via contact with one of pair of said first and second cams according to a rotational movement of camshaft;

a first rocker arm moving device which moves said rocker arms from a first operating position toward a second operating position;

a second rocker arm moving device which moves said rocker arms from the second operating position toward the first operating position; and a rocker arm movement restraining device which restrains the movement of said rocker arms in the axial direction;

said rocker arm movement restraining device comprising an arm member which engages said rocker arms for restraining the axial movement thereof; and a third cam disposed on the camshaft for activating said arm member and releasing the engagement of the rocker arms with the arm member when the camshaft is rotated;

wherein said arm member adapted to release the engagement with the rocker arms, when said valves are closed, for positioning thereof to one of the operating positions by one of the first rocker arm moving device and the second rocker arm moving device.

9. A valve device for an engine according to claim 8, wherein said left rocker arm comprises a base portion and a flange disposed on the base portion; wherein the arm member engages the flange disposed on the base portion thereby allowing passage of said rocker arm shaft therethrough.

10. A valve device of an engine according to claim 8, wherein each of said rocker arms comprises a base portion; and wherein a force is applied in the axial direction to the base portions of the rocker arms to move said rocker arms so as to allow movement of said rocker arm shaft therethrough.

11. A valve device of an engine according to claim 9, wherein said right rocker arm comprises a base portion; and wherein a force is applied in the axial direction to the base portions of the rocker arms to move said rocker arms so as to allow movement of said rocker arm shaft therethrough.

12. A valve device of an engine according to claim 8, wherein:

each of said rocker arms comprises a base portion;

said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by an engine structure so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

13. A valve device of an engine according to claim 9, wherein:

said right rocker arm comprises a base portion;

said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by an engine structure so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

14. A valve device of an engine according to claim 10, said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by an engine structure so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

15. An engine comprising a cylinder head having a first and second intake valves;

a camshaft having a pair of first and second cams operatively associated with respective one of said first and second intake valves; and a valve operating device operable to close and open one said first and second intake valves;

said valve operating device comprising:

a rocker arm shaft extending parallel to the camshaft;

a left and a right rocker arms supported on the rocker arm shaft;

said rocker arms operable to open and close the one of said first and second intake valves via contact with one of pair of said first and second cams according to rotational movement of camshaft;

a first rocker arm moving device which moves said rocker arms from a first operating position toward a second operating position;

a second rocker arm moving device which moves said rocker arms from the second operating position toward the first operating position; and a rocker arm movement restraining device which restrains the movement of said rocker arms in the axial direction;

said rocker arm movement restraining device comprising an arm member which engages said rocker arms for restraining the axial movement thereof; and a third cam disposed on the camshaft for activating said arm member and releasing the engagement thereof with the rocker arms when the camshaft is rotated;

wherein said arm member adapted to release the engagement with the rocker arms, when said valves are closed, for movement thereof to one of the operating positions by one of the first rocker arm moving device and the second rocker arm moving device.

16. An engine according to claim 15, wherein said left rocker arm comprises a base portion and a flange disposed on the base portion of the rocker arm; wherein the arm member engages the flange disposed on the base portion thereby allowing passage of said rocker arm shaft therethrough.

17. An engine according to claim 15, wherein each of said rocker arms comprises a base portion; and wherein a force is applied in the axial direction to the base portions of the rocker arms to move said rocker arms so as to allow movement of said rocker arm shaft therethrough.

18. An engine according to claim 16, wherein said right rocker arm comprises a base portion; and wherein a force is applied in the axial direction to the base portions of the rocker arms to move said rocker arms so as to allow movement of said rocker arm shaft therethrough.

19. An engine according to claim 15, wherein:

each of said rocker arms comprises a base portion;

said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by an engine structure so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

20. An engine according to claim 16, wherein:

said second rocker arm comprises a base portion;

said first rocker arm moving device comprises a first spring;

said second rocker arm moving device comprises a second spring;

wherein one end of said first spring and said second spring is engaged with said base portion of respective one of said rocker arms;

said first and second springs allow passage of the rocker arm shaft therethrough and provide a force in the axial direction thereto;

said rocker arm shaft includes a first spring receiving collar and a second spring receiving collar, each supported on the outer periphery of the rocker arm shaft so as not to move relatively in the axial direction;

each of said first spring receiving collar and said second spring receiving collar engages the other end of respective said springs;

said rocker arm movement restraining device comprises second arm members for restraining the axial movement of the rocker arms until the predetermined force is accumulated in one of said springs;

the rocker arm shaft is supported by the cylinder head so as to be movable in the axial direction thereof; and wherein the rocker arm shaft moves in the axial direction with respect to the engine structure together with the spring receiving collars in a state in which the second arm members restrain the axial movement of the rocker arms with respect to the engine structure so that the predetermined force is accumulated in one of the springs; and wherein one of the spring receiving collars comes in contact with the second arm members when the predetermined force is accumulated to release respective one of said rocker arms restrained by the second arm members.

* * * * *